US006138662A

United States Patent [19]

Jones

[11] Patent Number: 6,138,662

[45] **Date of Patent: *Oct. 31, 2000**

[54] HEATERS

[75] Inventor: David Mervyn Jones, Copthorne, United Kingdom

[73] Assignee: Philomena Joan Jones, West Sussex, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,768

[22] PCT Filed: Sep. 28, 1995

[86] PCT No.: PCT/GB95/02313

§ 371 Date: Mar. 28, 1997

§ 102(e) Date: Mar. 28, 1997

[87] PCT Pub. No.: WO96/10720

PCT Pub. Date: Apr. 11, 1996

[30] Foreign Application Priority Data

Sep. 30, 1994 [GB] United Kingdom ..... 9419771
Sep. 30, 1994 [GB] United Kingdom ..... 9419772

[51] Int. Cl.[7] ..... F24C 3/00

[52] U.S. Cl. ..... 126/91 A; 126/92 B; 237/70; 219/347; 431/215

[58] Field of Search ..... 126/91 A, 91 R, 126/285 R, 285 A, 92 B; 432/222, 223; 431/215, 352, 353; 392/376

[56] References Cited

U.S. PATENT DOCUMENTS

| | | | |
|---|---|---|---|
| 2,439,038 | 4/1948 | Cartter | 126/91 A |
| 2,837,893 | 6/1958 | Schirmer | 431/352 |
| 3,273,623 | 9/1966 | Nrsbitt | 431/352 |
| 3,779,694 | 12/1973 | Zagoroff | 431/352 |
| 4,044,751 | 8/1977 | Johnson | 126/91 A |
| 4,062,343 | 12/1977 | Spielman | 126/91 A |
| 4,124,353 | 11/1978 | Prudhon | 431/352 |
| 4,187,835 | 2/1980 | Finney | 126/91 A |
| 4,245,778 | 1/1981 | Diermayer | 126/285 R |
| 4,319,125 | 3/1982 | Prince | 219/347 |
| 4,676,222 | 6/1987 | Jones et al. | 126/91 A |
| 4,846,145 | 7/1989 | Inouci et al. | 126/91 A |
| 5,580,238 | 12/1996 | Charles, Sr. et al. | 431/351 |

FOREIGN PATENT DOCUMENTS

| | | |
|---|---|---|
| 0 232 990 | 1/1987 | European Pat. Off. . |
| 0 408 396 A3 | 7/1990 | European Pat. Off. . |
| 2 609 527 | 1/1987 | France . |
| WO 91/06810 | 5/1991 | WIPO . |

*Primary Examiner*—James C. Yeung
*Attorney, Agent, or Firm*—Lahive & Cockfield, LLP

[57] ABSTRACT

The invention provides a radiant heater comprising a radiative heating element (15, 16); a housing (1), the underside of which is recessed to receive the radiative heating element (15, 16), the radiative heating element being disposed beneath the housing (1) such that its upper half is wholly within the recess, and at least a portion of its lower half protrudes downwardly from the recess; the recess having a heat reflective surface (5*a*, 5*b*, 5*c*, 6*a*, 6*b*, 6*c*) for reflecting heat radiation from the radiative heating element (15,16) in a downwards direction; the housing (1) having means (9) enabling the attachment thereto of a reflective skirt (19) for focusing the radiation emitted from the radiative heating element (15,16).

23 Claims, 12 Drawing Sheets

HEATERS

BACKGROUND OF THE INVENTION

The present invention relates to heaters of the type in which a combustible substance is burnt to release heat. More particularly the invention relates to radiant heaters for heating industrial buildings such as factories, warehouses, hangers and other large structures.

It is known to heat large buildings, and in particular large industrial premises by means of radiant heaters, and typical radiant heaters used for this purpose consist of a U-tube radiator system, a burner such as a gas burner being connected to one end of the tube and a fan being arranged at the other end of the tube for extracting combustion gases from the tube. The U-tube is suspended below a heat reflective housing, which reflects radiation emitted from the tube towards the ground. Such a heater is disclosed in, for example, British Patent Application GB 2145218.

A major problem encountered with such radiant heaters lies in ensuring that the radiant flux density at ground level is as uniform as possible, and that hot spots and cold spots are avoided. This represents a problem because whilst a particular form of radiant heater may be configured to provide optimal heating in a building of one size and shape, it may provide a far from ideal heating effect when used in a building of a different size and shape. In particular, it has proved difficult to compensate for variations in the mounting height above ground level, the mounting height generally being dependent upon the availability of support structures such as roof support structures on which to mount the heaters.

SUMMARY OF THE INVENTION

The present invention sets out to overcome these problems by providing, in one aspect, a modular heating assembly comprising a basic heater unit to which may be attached a reflective skirt having any one of a plurality of reflector configurations. In accordance with one aspect of the invention, a reflective skirt of a particular configuration may be selected to provide the desired reflective pattern and consequent radiant flux density at a given location at ground level in a building.

A further object of the invention is to improve the radiant efficiency of such heaters, and to minimize heat losses due to conduction and convection.

A still further object of the present invention is to provide a heater which is more efficient, in the sense that a greater heating effect is obtainable for the same consumption of fuel, or alternatively that less fuel is required to achieve the same heating effect.

Accordingly, in a first aspect, the invention provides a process for fitting a heating system in a building, the heating system comprising overhead radiant heaters with skirt portions for directing the radiated heat towards the floor of the building, the process comprising the steps of:

(i) measuring the building floor area A;

(ii) determining the desired temperature rise $\Delta T$ above ambient;

(iii) from A and $\Delta T$, determining the required floor radiant flux density Q;

(iv) from Q and the performance of a heater, determining the number N of heaters;

(v) from A and N, determining a desired floor radiant flux pattern for an individual heater;

(vi) from the floor radiant flux pattern, selecting a skirt having a configuration to achieve that pattern;

(vii) attaching the selected skirt to a heater; and (viii) installing the heater and skirt in the building.

In a second aspect, the invention provides a radiant heater comprising a radiative heating element; a housing, the underside of which is recessed to receive the radiative heating element, the radiative heating element being disposed beneath the housing such that its upper half is wholly within the recess, and at least a portion of its lower half protrudes downwardly from the recess; the recess having a heat reflective surface for reflecting heat radiation from the radiative heating element in a downwards direction; the housing having means enabling the attachment thereto of a reflective skirt for focusing the radiation emitted from the radiative heating element.

The radiative heating element may be, for example, a radiant heater tube heated by a gas burner, or may be an electrically heated heating element.

In one embodiment, the radiant heater comprises a tube, a burner communicating with one end of the tube; and extraction means communicating with the other end of the tube for extracting combustion gases from the tube.

The recess on the underside of the housing is preferably in the form of a channel, e.g. an elongate channel. Thus the radiative heating element is disposed beneath the housing such that its upper half is wholly within the channel, and at least a portion of its lower half protrudes downwardly from the channel.

In one particular embodiment, there is provided a radiant heater comprising a tube, a burner communicating with one end of the tube; extraction means communicating with the other end of the tube for extracting combustion gases from the tube; a housing, the underside of which defines a channel; the tube being disposed beneath the housing such that its upper half is wholly within the channel, and at least a portion of its lower half protrudes downwardly from the channel; the channel having a heat reflective surface for reflecting heat radiation from the tube in a downwards direction; the housing having means for enabling the attachment thereto of a reflective skirt for focusing the heat radiation.

Preferably the housing is provided with a plurality of mounting brackets for attachment beneath the housing at spaced intervals thereon; the mounting brackets having first mounting means for supporting the tube beneath the housing, and second mounting means for the attachment thereto of the reflective skirt.

The housing may carry a plurality of radiant heater tubes. Preferably the radiant outputs of the tubes are matched such that the radiant heater has a substantially uniform total radiant output along its length.

In one embodiment, the channel is divided into a pair of sub-channels arranged side by side and separated by a central barrier, each sub-channel having a tube disposed therein. Preferably the two tubes constitute the two limbs of a U-tube burner, the burner being arranged to communicate with one end of the U-tube, and the extraction means being arranged to communicate with the other end.

Preferably, the central barrier tapers in a downwards direction. Most preferably the central barrier extends downwardly such that its lower edge is aligned with lower edges of the walls of the channels.

The central barrier typically has opposing walls which have an angle of inclination or a curvature which mirrors an angle of inclination or curvature of an opposing wall of the channel.

Preferably the channel and/or each sub-channel functions in the manner of a parabolic reflector.

For ease of construction, and to enable the housing to be fabricated by simple metal bending operations, the channel and/or each sub-channel may have a generally planar upper surface, and generally planar side surfaces diverging downwardly from the edges thereof.

The mounting bracket may be attached to the housing by any suitable means, and for example may be bolted, riveted, or welded so as to provide a removable or fixed connection with the housing.

The housing may advantageously be thermally insulated to limit heat loss through conduction and convection via the upper and side surfaces thereof.

Accordingly, in a third aspect, the invention provides a radiant heater comprising: a radiative heating element; a housing, the underside of which is recessed to receive the radiative heating element, the radiative heating element being disposed beneath the housing such that its upper half is wholly within the recess, and at least a portion of its lower half protrudes downwardly from the recess; the recess having a heat reflective surface for reflecting heat radiation from the radiative heating element in a downwards direction; wherein at least a portion of the housing surrounding the recess is thermally insulated to reduce heat loss through the housing.

The radiative heating element may take the form of a radiant heater tube heated by a gas burner or an electrically heated heating element as hereinbefore defined. For example the heating element may comprise: a tube, a burner communicating with one end of the tube; and extraction means communicating with the other end of the tube for extracting combustion gases from the tube.

The housing can have a downwardly open channel on the underside thereof, within which is mounted the tube; the channel having a heat reflective surface for reflecting heat radiation from the tube in a downwards direction; and wherein at least a portion of the walls defining the channel have on or adjacent an upper surface thereof a layer of thermal insulation material.

In one embodiment, the housing comprises inner and outer skins, the inner skin defining the walls of the channel and the outer skin defining the upper surface of the housing, the space between the inner and outer skins being at least partially filled with thermal insulating material.

The thermal insulating material is preferably one which is capable of resisting temperatures in excess of 500° C., and in particular temperatures above 600° C.

In order to improve the reflective efficiency of the reflective surfaces of the channel, the reflective surfaces are preferably surfaces which have been treated to reduce surface porosity and unevenness and improve reflectance. For example, the surfaces may be of anodised aluminium, and in particular may be formed of a coloured anodised aluminium, most preferably a gold coloured anodised aluminium. Gold coloured anodised aluminium is considered to be particularly efficient at reflecting radiation in the context of the heaters of the present invention.

In order to allow the angle of spread of the radiation emitted from the heater to be adjusted, the heater will preferably be provided with means for adjusting the height of the tube within the housing. For example, the means for adjusting the height of the tube within the housing may take the form of adjustable length cables extending between opposing mounting points on the mounting bracket, on which cables, the tube or tubes is or are supported, the cables being adjustable such that shortening the cable results in the raising of the tube, whilst lengthening the cable results in the lowering of the tube.

The cable may take the form of a flexible stainless steel cable having non-ferrous mountings and length adjusters on either end thereof. The mountings may for example take the form of hooks or eyes for engaging complementary hooks or eyes on the mounting bracket. The length adjusters typically take the form of screw adjusters.

In a fourth aspect of the invention, there is provided a radiant heater as hereinbefore defined, in combination with a reflective skirt for mounting on said mounting bracket.

The reflective skirt may have downwardly divergent walls, or may have generally parallel walls, or a combination thereof. The reflective skirt advantageously has a reflective surface of the same composition as the reflective surface of the housing.

The reflective skirt may be mounted on the brackets, and may additionally be provided with mounting points for securing directly to the housing. For example, the reflector skirt may be bolted or riveted directly to the housing, as well as being secured to the mounting brackets.

An advantage of the radiant heaters hereinbefore defined is that once the optimal reflector configuration has been selected for a given location in a building, a heater having the desired configuration may simply and easily be fabricated by attaching to the housing an appropriately configured set of brackets and an appropriately configured reflector skirt. The present invention thus provides a means of optimising the heating of a building.

As is evident from the foregoing, the present invention is particularly (although not exclusively) concerned with radiant heaters, ie heaters in which the object or room to be heated is so heated by radiation emitted by the heater. These can be contrasted with convective heaters in which air in the vicinity of a heating element is heated by conduction, and then distributed to a region to be heated.

Since the radiation emitted by a hot body is related to the temperature of that body by a power law, it follows that increased efficiency can be obtained from a radiant heater by running it such that the heating element is as hot as possible. Heaters of the type proposed in GB2145218 comprise an elongate tube into which is directed an ignited combustible mix. The burning of the mix heats the elongated tube, which then emits radiation.

The present inventor has found that one limiting factor on the efficiency of such a heater is the formation of "hot spots" on the surface of the heater, where the flame comes into direct contact with the wall of the tube. If the combustible mix is adjusted to provide a higher running temperature, the number and temperature of such hot spots increases, eventually leading to failure of the element.

In its fifth aspect, the present invention therefore provides a heater comprising an elongate combustion chamber, one end of which is adapted to be supplied with a combustible mix, the chamber having an inner liner which extends from that one end along the interior of the chamber and into which the combustible mix is supplied, the liner having a smaller cross-section than the chamber, and being perforated. Thus, the flame can be retained within the liner but supplied with air from the region between the liner and the inner wall chamber, which can enter the liner via the perforations.

Since the problem of hot spot formation is at its most severe at the end where the combustible mix is supplied, but is less so or negligible at the distant end of the elongated combustion chamber, it is not necessary for the liner to extend along the whole length of the combustion chamber. Indeed, it is preferred that the liner is shorter than the chamber, to reduce cost and simplify construction.

In a preferred form of this fifth aspect of the invention, at the first end of the combustion chamber, the liner is provided with a flared portion which extends out of the combustion chamber and into which the combustible mix is directed. Thus, the combustible mix is more easily directed into the liner, and a positive gap can be left between the flared portion and the inlet to the combustion chamber to allow air into the combustion chamber.

In this fifth aspect of the invention, since the flame is kept separate from the wall of the heating element, the flame temperature can be increased resulting in increased efficiency.

A suitable form for the combustion chamber is an elongate tube, and the inner liner can then be a smaller tube within that.

According to a sixth aspect, the present invention provides a heater comprising a combustion chamber having an inlet for a combustible mix, the combustible mix including a fuel component and an air component, wherein at least the air component is heated prior to mixing by being directed past the combustion chamber.

Thus, less heat is wasted in raising the inlet air to the temperature of the flame, and accordingly the flame can be run more efficiently.

A particularly suitable arrangement for directing the air component past the combustion chamber is to provide the combustion chamber in elongate form, the inlet being at a first end, the air component being directed alongside the length of the chamber. Thus, the inlet air is heated for a relatively long time and hence more efficiently, particularly if it flows from a distant end of the combustion chamber to the first end of a combustion chamber.

It is preferred that the elongate chamber comprises two interconnected portions lying alongside each other, with the air component being directed along the elongate region between the two portions. In this arrangement, inlet air will be heated from both sides, and hence more efficiently. A suitable form for such an elongate chamber is a single tube bent to form a U-shape.

Where the combustion chamber is elongate, it is inevitable that the first end, at which the combustible mix is supplied, will be hotter than the distant end, where combustion products and flue gas are released. Thus, at the first end the radiative power of the heater is at its greatest, whilst at the distant end it is possible that a majority of the heat is dissipated by conduction to the surrounding air and hence can be lost by convection of that air.

Thus, in its seventh aspect, the present invention provides a heater comprising an elongate combustion chamber supplied at an inlet with a combustible mix including a fuel component and an air component, wherein the air component consists substantially of air taken from the vicinity of the end of the elongated combustion chamber distant from the inlet. By distant is meant spaced along the length of the combustion chamber. Thus, in cases where the elongate chamber is a single tube bent to form a U-shape the distant end of the chamber may well be spatially adjacent the inlet.

It is preferred that the air component of the combustible mix consists essentially of air taken from the vicinity of the combustion chamber distant from the inlet.

In many situations, a heater might be required to operate for short periods, interspersed with rest periods. Thus, it is desirable for the heater to reach its equilibrium running state swiftly. For example, if a heater requires five minutes to reach its running state, but is only required to run for ten minutes at a time, then the heater will only be running at peak efficiency for 50% of the time. Furthermore, it has been appreciated by the inventor that the ratio of fuel and air components of the combustible mix will change as the temperature of the two components change. This arises simply because as the temperature increases, the volume of a fixed mass of gas will increase and hence to maintain stoichiometric conditions, a correspondingly greater volume of air will be required. Thus, if at or immediately after start-up the fuel-air mixture is set at that found to be suitable at the higher running temperature, then the reduced burning efficiency at lower temperatures will mean that the heater will take longer than necessary to reach its running temperature.

Therefore, the present invention provides in its eighth aspect a heater comprising a combustion chamber, a flue, and a suction means for drawing air out of the flue from the combustion chamber, the volume rate of air drawn from the suction means being dependant upon the temperature of the air being drawn.

A bimetallic element is suitable for detecting the temperature. Whilst this temperature detection could be done actively, by sensing the position of the bimetallic element or the return from another suitable temperature sensing element, and adjusting the suction means accordingly, it is preferred in this eighth aspect of the present invention that the bimetallic element itself partly covers the flue outlet and is arranged such that it progressively further uncovers that outlet as the temperature of the element increases. Hence, adjustment is passive, ie. automatic and requires no adjustment or complex active interaction.

Greater effectiveness can be achieved by this arrangement if it is combined with the provision of further flow restrictions in the combustion chamber.

BRIEF DESCRIPTION OF THE DRAWINGS

The invention will now be illustrated, by way of example, by reference to the accompanying drawings in which.

DESCRIPTION OF ILLUSTRATED EMBODIMENT

Figure 9:
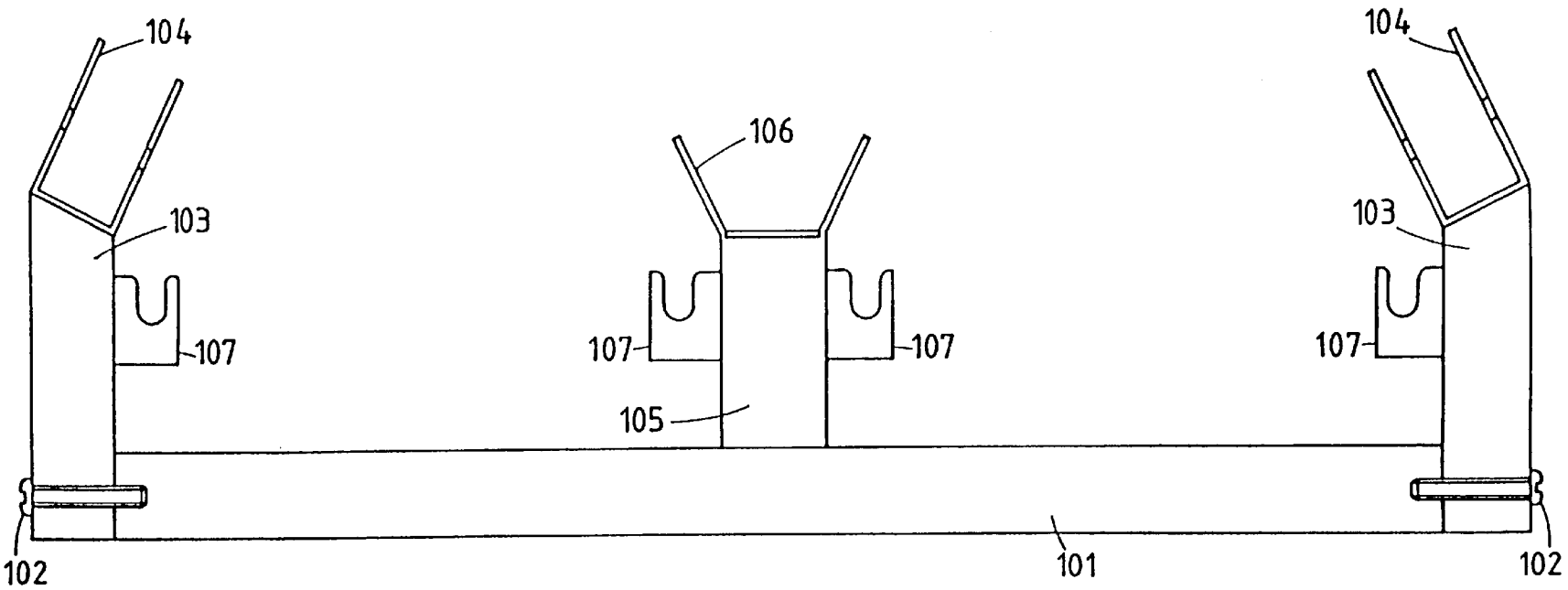
FIG. 9 is a sectional elevation of the bracket shown in FIG. 3.

Referring now to FIGS. 1 to 4, it can be seen that in one embodiment, the radiant heater comprises a housing generally designated 1 having an outer wall 2 formed of mild steel and formed so as to have a generally horizontal region 2*a* and downwardly divergent portions 2*b* and 2*c*. Secured to the outer wall 2 by means of riveted joints at location 2*d* is an inner wall 3, formed of bent aluminium sheet, the downwardly facing surface of which has been anodised, and preferably provided with gold colour. Inner wall 3 is shaped so as to define two downwardly open sub-channels 5 and 6, each of the sub-channels having an upper reflective surface 5*a*, 6*a*, and downwardly divergent lateral reflective surfaces 5*b*, 5*c*, 6*b*, 6*c*. Surfaces 5*c* and 6*c*, together with a linking lower wall 7 form a central barrier portion 8, the function of which will become apparent from the following description. At spaced (e.g. one meter) intervals along the housing, brackets 9 are secured to the housing. Bracket 9 is illustrated in FIG. 9, where it can be seen that the bracket has a generally horizontal cross-bar portion 101 formed of box section steel and, secured thereto, by means of bolts 102, a generally upright member 103 at the upper ends of which are secured attachment brackets 104 of channel section. At the midpoint of the cross-bar portion 101, is secured, by welding, a short transversally mounted piece of steel box section 105 from the upper corners of which extend divergent arms 106, which in use are arranged to embrace, but are not fixedly attached to, the central barrier portion 8 of the housing. The bracket is secured to the housing by means of mounting fixtures 104 which fit over the lower edges of the housing and are secured in place thereon by means of bolts 10.

The brackets 9 are provided with inwardly facing pairs of hook elements 107 which engage the retaining rings 11 on the respective ends of tube-supporting cables 12.

Tube-supporting cables 12 are typically formed from a flexible high temperature resistant metallic material such as steel, and are provided with screw adjusters 13 formed from a non ferrous metal such as brass which allow the cables 12 to be shortened or lengthened. Burner tubes 15 and 16 rest loosely on the cables 12 and, as will be appreciated, the height of the tube within the housing may be varied by shortening or lengthening the supporting cables 12.

The burner tubes 15 and 16 extend along the channel from one end of the housing to the other, tube 15 being connected at one end 17 with a gas burner (not shown) which heats the interior of the tube. Combustion gases are drawn along the tube from the burner 17 via a U-bend (not shown) at location 19 and into the return tube 16 by means of an extraction fan (not shown) mounted at end 18.

The tubes 15 and 16 are formed from steel, and may be surface treated to maximise their radiative efficiency. In use, the tube 15 is heated by means of the gas burner and then functions as a radiator heating element, with radiation from the surface of the tube being reflected by reflective surfaces 5*a*, 5*b* and 5*c* in a downwards direction.

Tube 16 also gives out radiation, but to a lesser extent since the tube is somewhat cooler than tube 15.

In order to prevent conductive and convective losses through the upper surface of the housing, a layer of insulation 14 is disposed between the inner and outer walls. The layer of insulation 14 fills the space between the inner 3 and outer 2 walls except at location 14*a*, where the surface 14*a* of the insulating material, together with walls 5*c* and 6*c* of the central barrier portion 7 define a hollow channel running along the length of the housing.

The thermal insulating material is selected so as to be resistant to the operating temperatures of the heater, and for example may be selected so as to resist temperatures of 600° C. and above.

Figure 2:
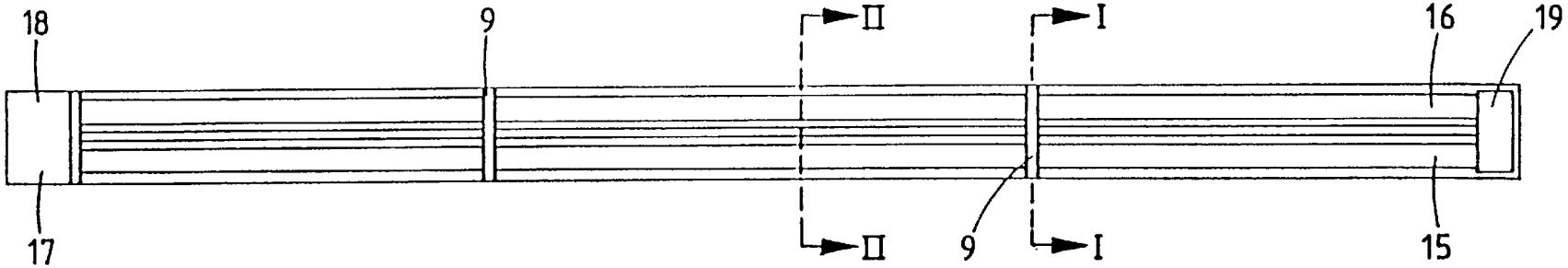
FIG. 2 is a plan view from below of the embodiment of FIG. 1.
Figure 1:
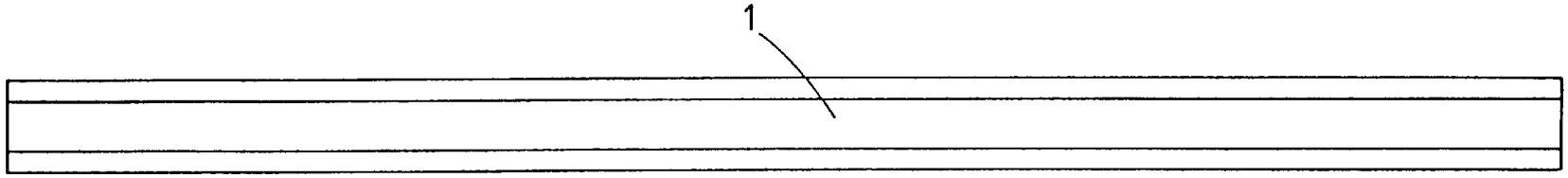
FIG. 1 is a plan view from above of a radiant heater according to one embodiment of the invention.
Figure 3:
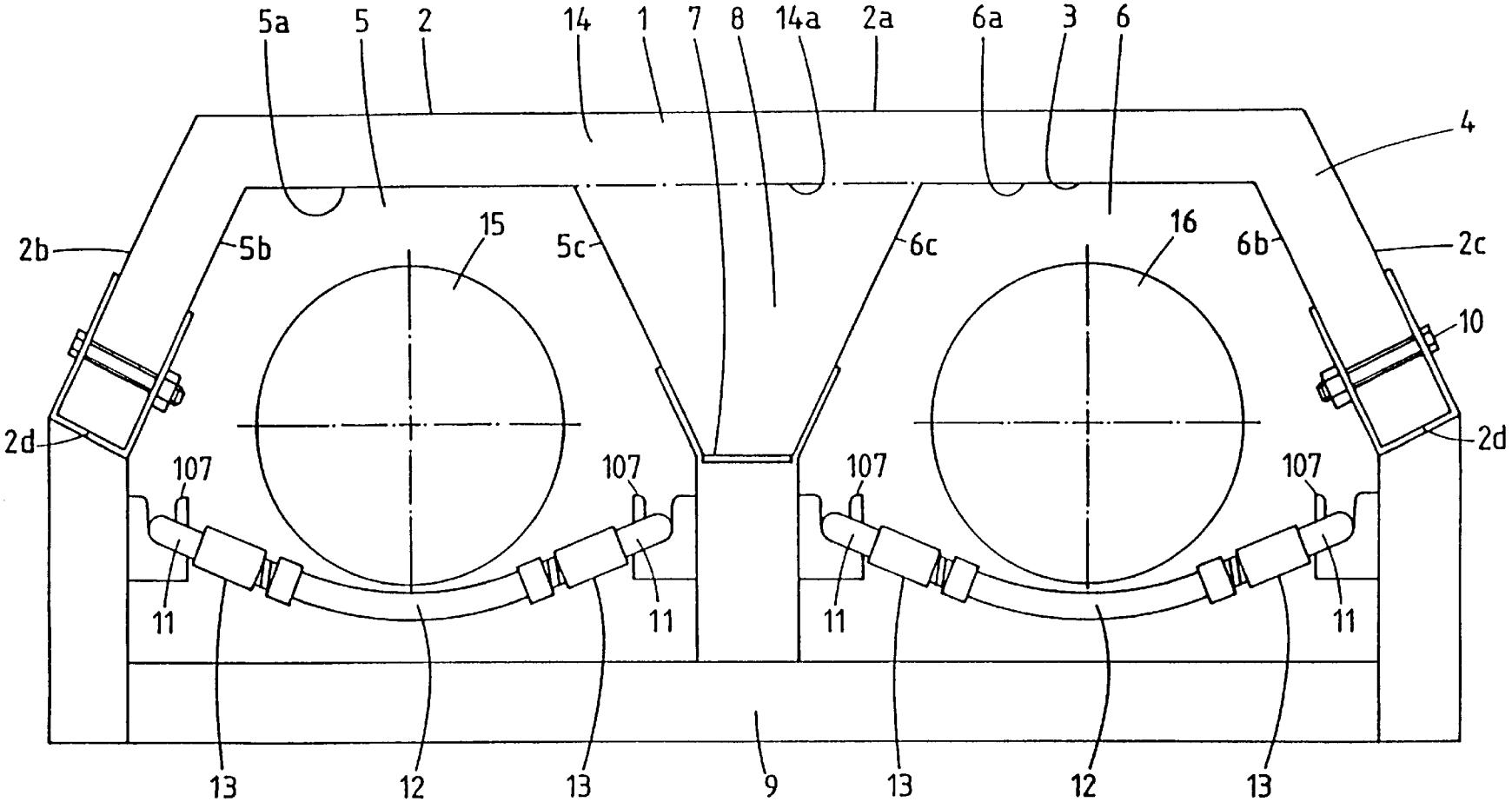
FIG. 3 is a sectional elevation along line I—I in FIG. 2.
Figure 4:
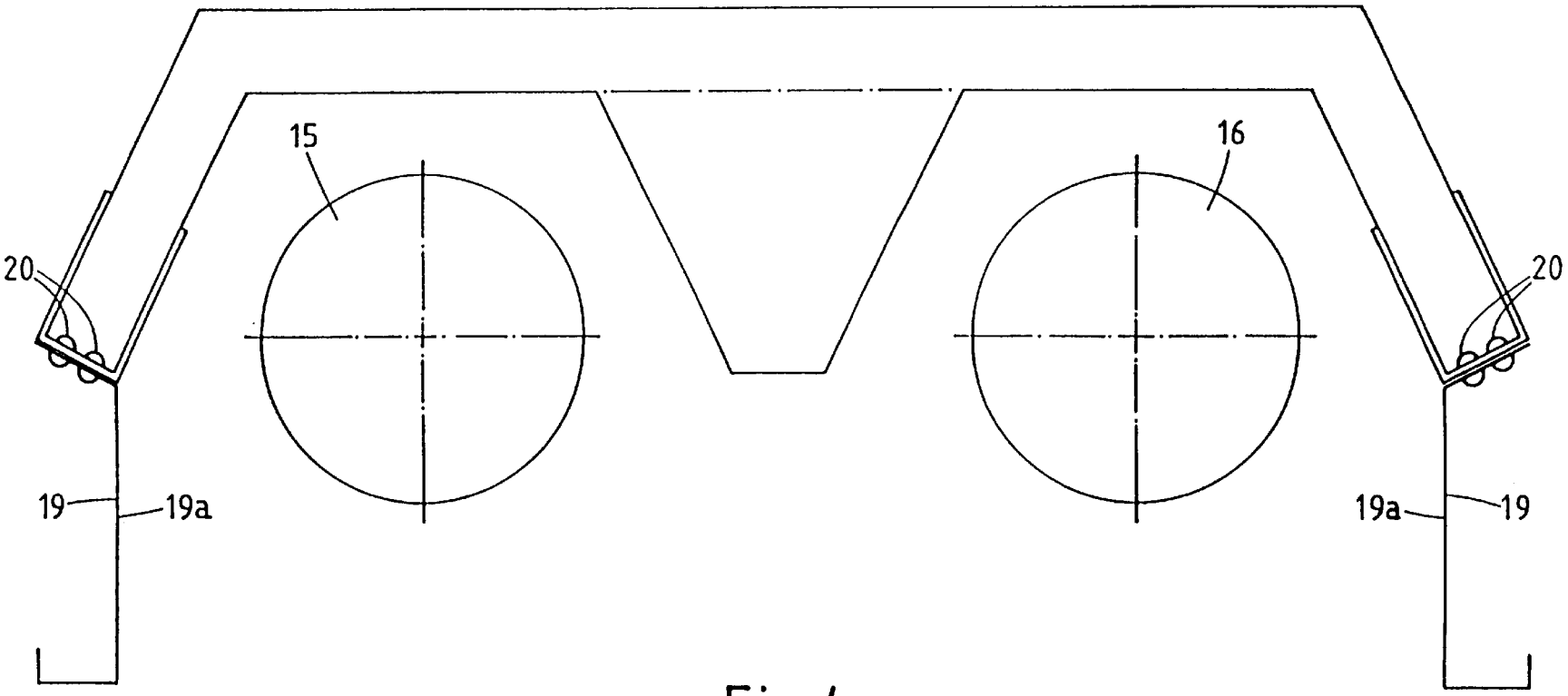
FIG. 4 is a sectional elevation along line II—II in FIG. 2.

As illustrated in FIG. 4, the housing has secured to the lower edges thereof a reflective skirt comprising side panels 19 having inwardly facing anodised aluminium reflective surfaces 19*a*. Panels 19 are secured to the housing by means of rivets 20 and are also mounted on, and held rigidly in place by, brackets 9. The reflector skirt 19 serves to focus and reduce the angle of spread of radiation from tubes 15 and 16.

Figure 5:
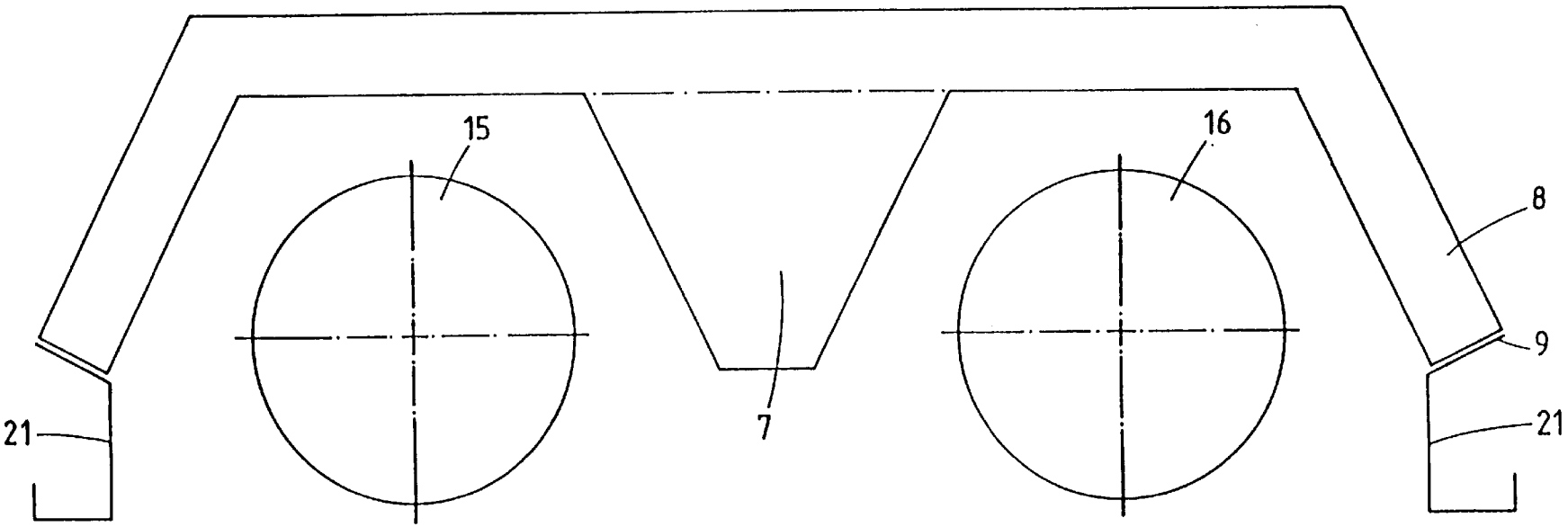
FIGS. 5 to 8 illustrate the embodiment of FIGS. 1 to 4, but with varying reflective skirt configurations.
Figure 6:
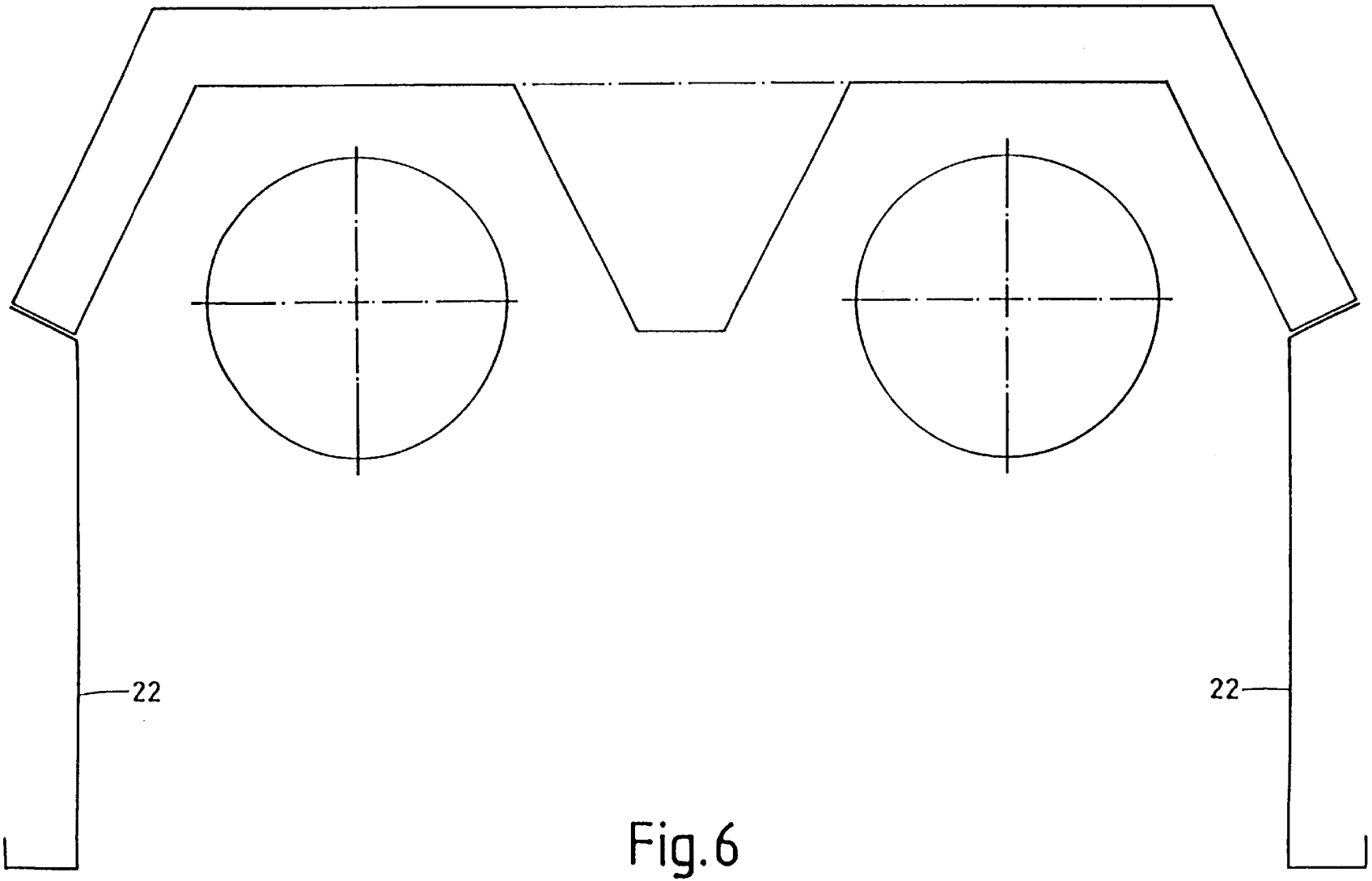

The reflective skirt 19 may be replaced by reflector skirt 21, 22, 23 or 26 as illustrated in any one of FIGS. 5 to 8 in order to vary the angle of spread of the radiation from the heater tubes. For example, when it is necessary to mount the heaters at a higher point within a building, e.g. as a result of the roof or ceiling support structure or other available supporting structures being much higher above the ground, a longer reflective skirt as illustrated in FIG. 6 may be employed to reduce the spreading of the radiation thereby to provide the desired radiative flux density at ground level. Conversely, where it is necessary to mount the heaters at a lower point in a building, the reflective skirt shown in FIG. 4 may be replaced by the shorter reflective skirt shown in FIG. 5.

Figure 7:
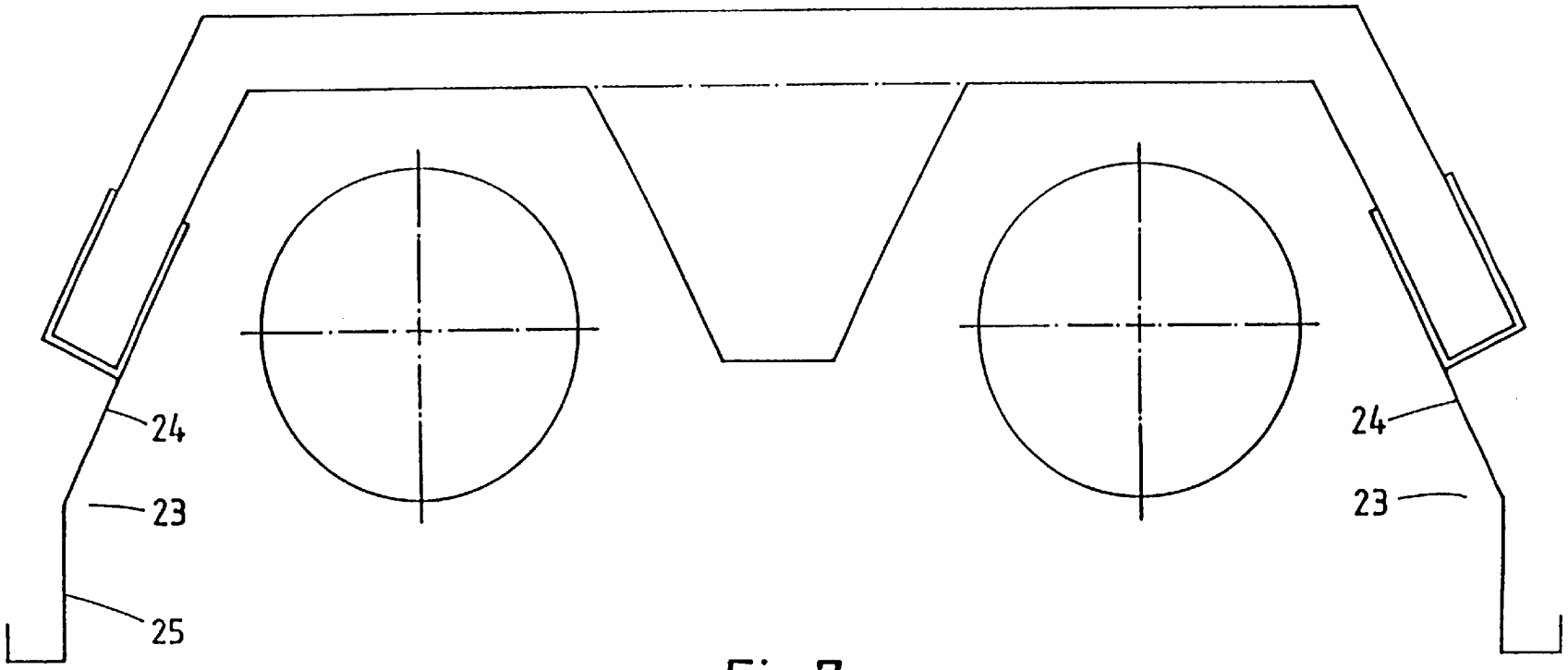
Figure 8:
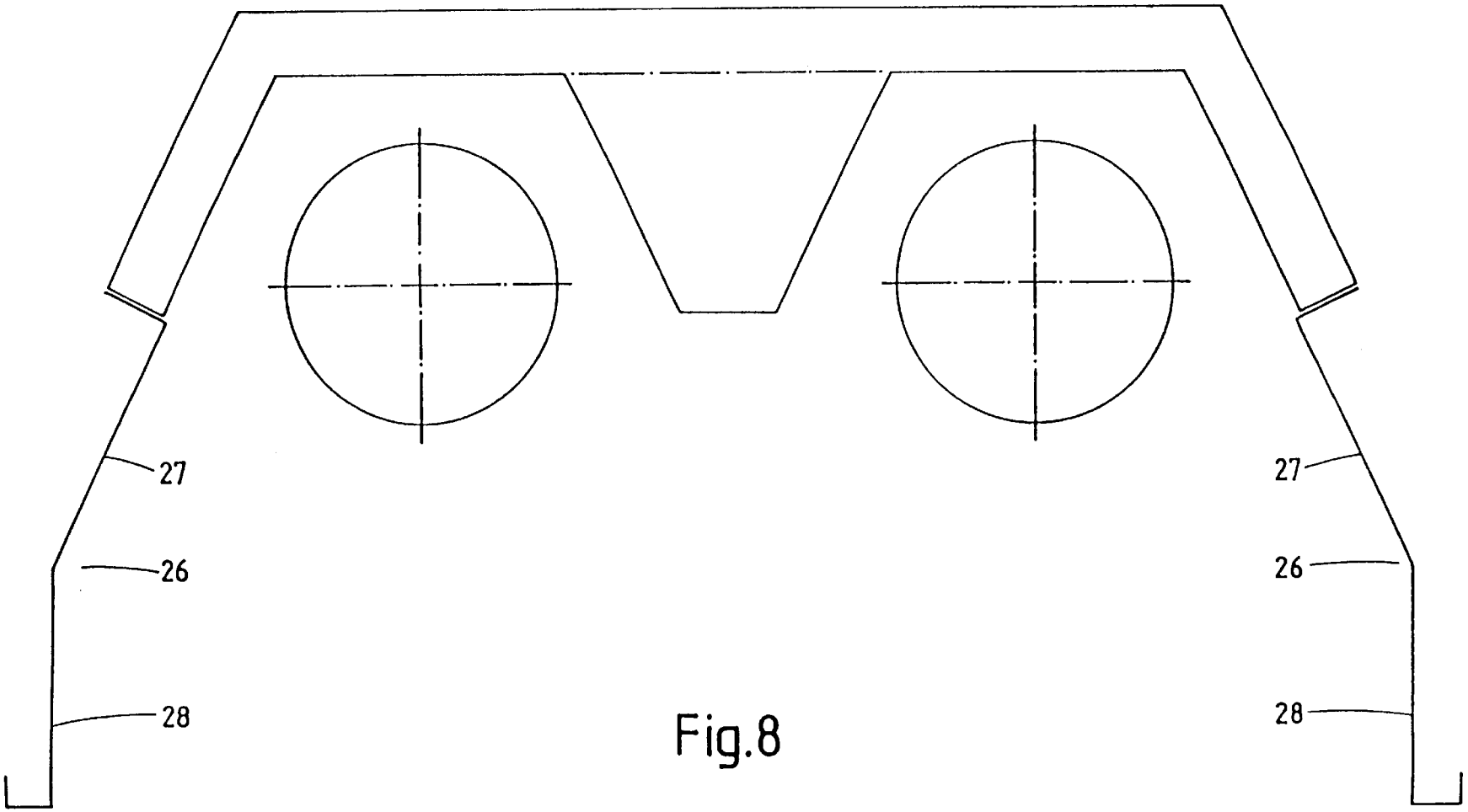

In FIGS. 5 and 6, the reflective skirts are shown as having generally parallel downwardly extending walls, but they may also, for example, be inclined, as illustrated in FIGS. 7 and 8, where the upper parts 24 and 27 respectively of the reflective skirts are divergent and follow the lines of the housing, and the lower parts 25, 28 of the reflective skirts 23, 26 respectively are substantially parallel.

When a heating system for a building incorporating the radiant heaters of the invention the building floor area A is first measured and the desired temperature rise $\Delta T$ above ambient is selected. From the floor area A and $\Delta T$, the required radiant flux density Q at floor level is then determined. Taking into account the height at which the heaters are to be suspended within the building, and taking into account also the shape of the floor area, an array of heaters is then chosen, each heater having a reflective skirt of the appropriate configuration to provide the desired radiant flux density at its given location in the building. As will be appreciated, the configuration of a reflective skirt for a heater in a corridor, alcove or bay would be different from the configuration of the reflective skirts on heaters in the main hall of a building.

An advantage of the embodiments of the present invention specifically set forth above is that they provide a basic radiant heater which can readily be adapted to provide the desired radiant flux density at a given location in a building by selecting an appropriately shaped reflector skirt. The radiant heaters according to this embodiment of the invention thus offer significant advantages over presently available radiant heaters which tend to be of fixed configuration and do not have the facility for modification in the manner illustrated above.

Figure 10:
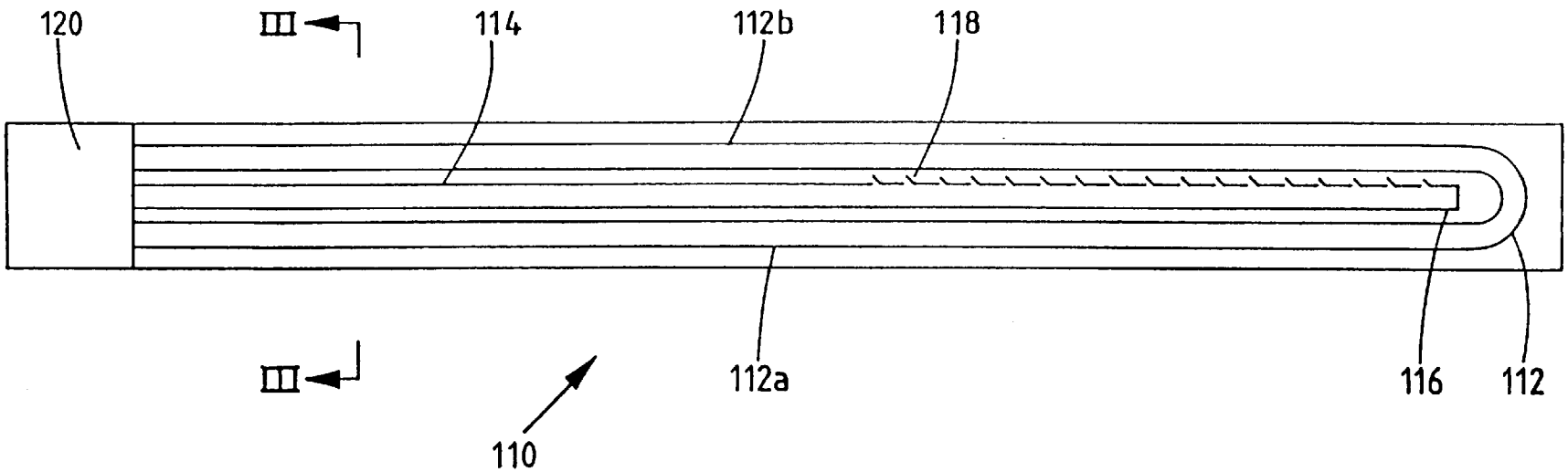
FIG. 10 is a view of a heater according to a second embodiment of the present invention from the underside.

A further aspect of the present invention is exemplified by the heater illustrated in FIG. 10. The heater 110 comprises a substantially U-shaped heater element 112 comprising a pair of linked generally parallel heater tubes 112*a* and 112*b*. Between the tubes 112*a* and 112*b* is a flow passage 114 having a closed distant end 116 lying in the base of the U defined by the heater tube 112. Louvres 118 are provided on the side of the flow passage 114 facing tube 112*b*, along roughly one-third of the length of the flow passage 114 nearest its distant end 116. The ends of the tubes 112*a*, 112*b* and flow passage 114 are enclosed in a compartment 120. The interior of the compartment 120 is shown in more detail in FIG. 12, described later.

Figure 11:
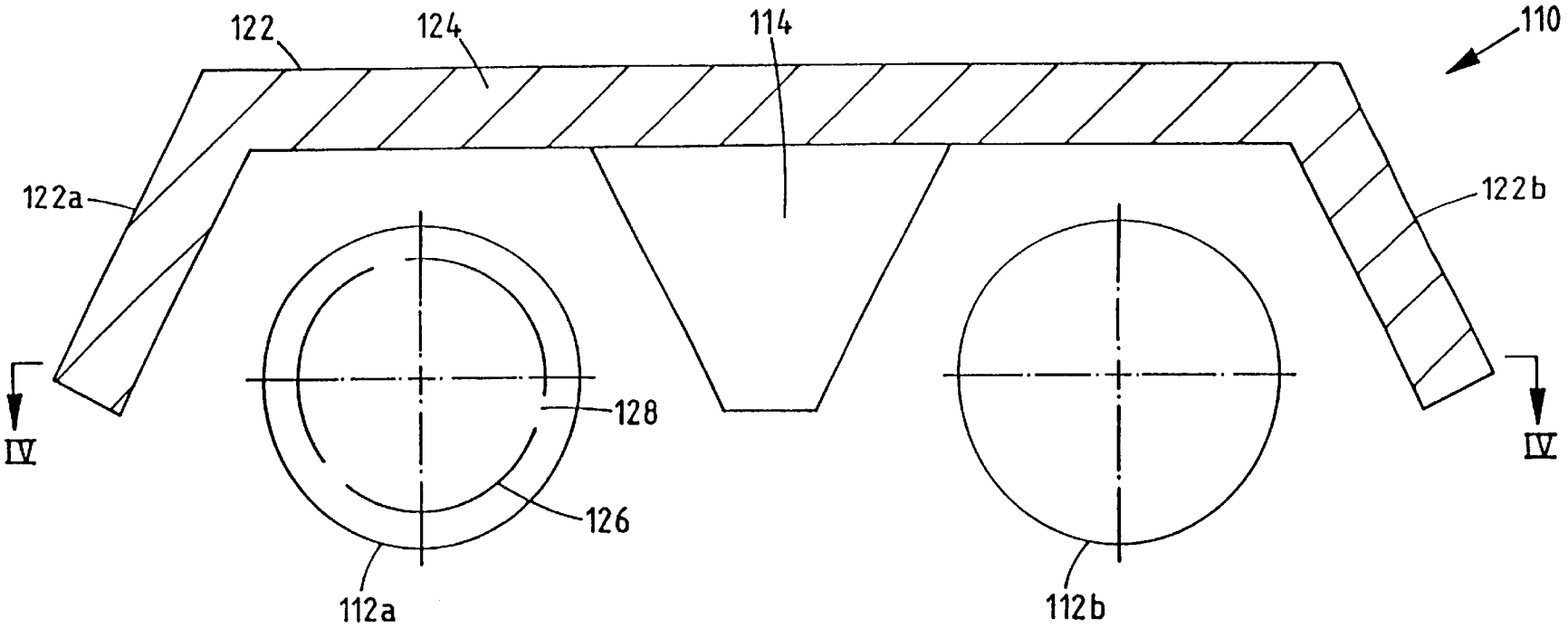
FIG. 11 is a section on III—III of FIG. 10.

FIG. 11 shows the heater in cross-section. It can be seen that the outer casing 122 comprises a generally hollow section filled with an insulating material 124. The casing 122 has side walls 122*a,* 122*b*. Suspended from the casing 122 is a hollow truncated V-section, which forms the flow passage 114 and which runs along the length of the casing 122. Thus, the casing 122, side walls 122*a* and 122*b,* and flow passage 114 between them define two elongate regions. Within these elongate regions are suspended the heater tubes 112*a* and 112*b* respectively. The suspension is achieved by a suspension means, not shown in FIG. 11. This can be as shown in the embodiments of FIGS. 1 to 9.

FIG. 11 also shows that tube 112*a* has an inner liner tube 126 which lies generally concentrically within tube 112*a* and is perforated by perforations 128.

Figure 12:
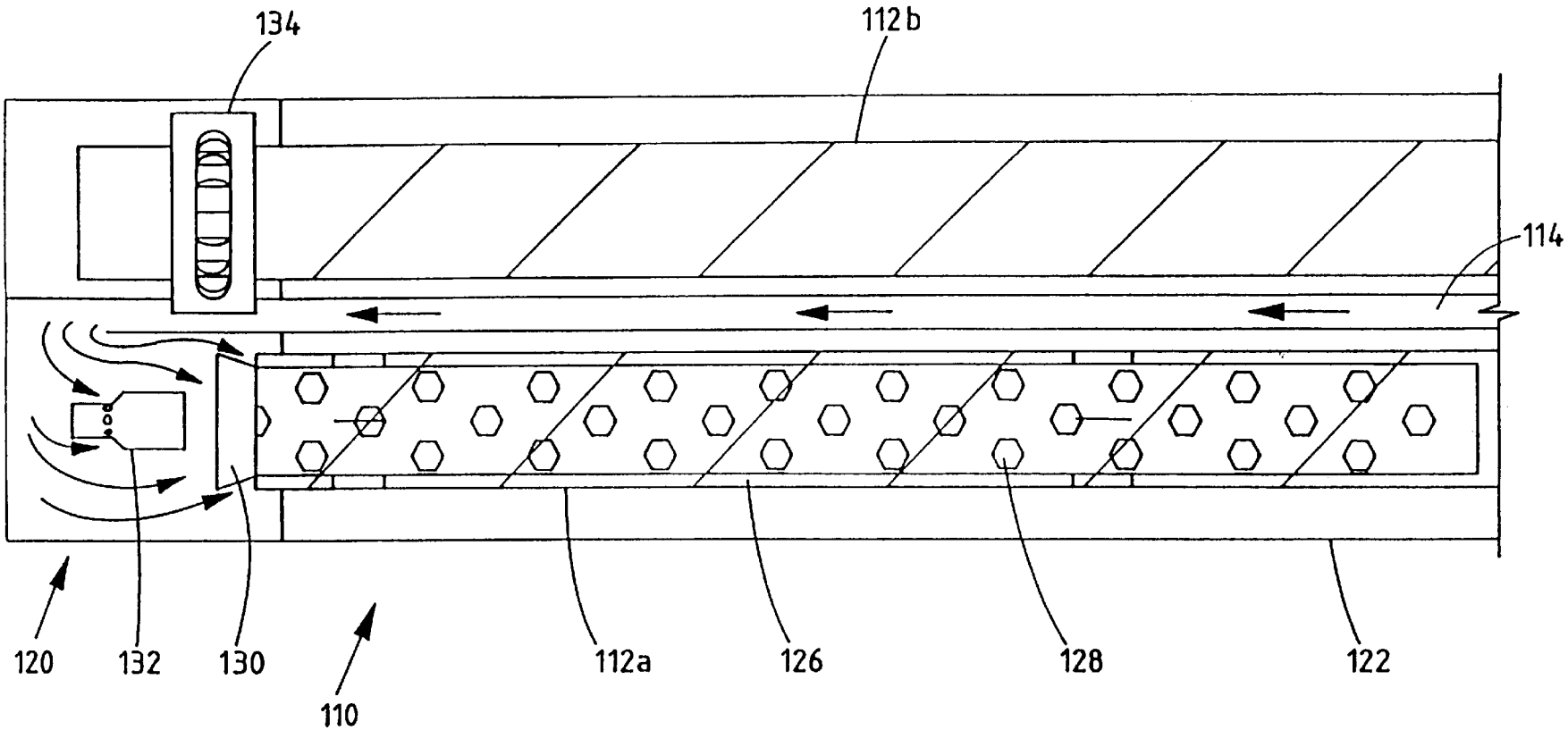
FIG. 12 is a partial cross-section on IV—IV of FIG. 11, and as such is an enlarged, partially sectional view of the inlet portion of FIG. 10.

Referring to FIG. 12, this shows the region about the enclosure 120 into which project the heater tubes 112*a* and 112*b*. Heater tube 112*a* can be seen to contain the inner liner tube 126 along part of its length, although both the inner liner tube 126 and heater tube 112*a* are coterminus at an open end within the enclosure 120. Inner liner tube 126 is, as previously mentioned, perforated by perforations 128. At the open end, the inner liner 126 is provided with a flared inlet 130. Facing the inlet 130 is a burner 132 supplied with fuel. Burner 132 is a standard item.

The heater tube 112*b* has an open end extending into the enclosure 120, where it is connected to a suction fan 134 which is arranged to extract gas from the heater tube 112*b* and vent it to atmosphere through a vent not shown in FIG. 12.

The interior of the enclosure 120 is partitioned to prevent gas flow between the free ends of the heater tubes 112*a* and 112*b*. The flow passage 114 communicates with the region into which tube 112*a* projects.

Figure 13:
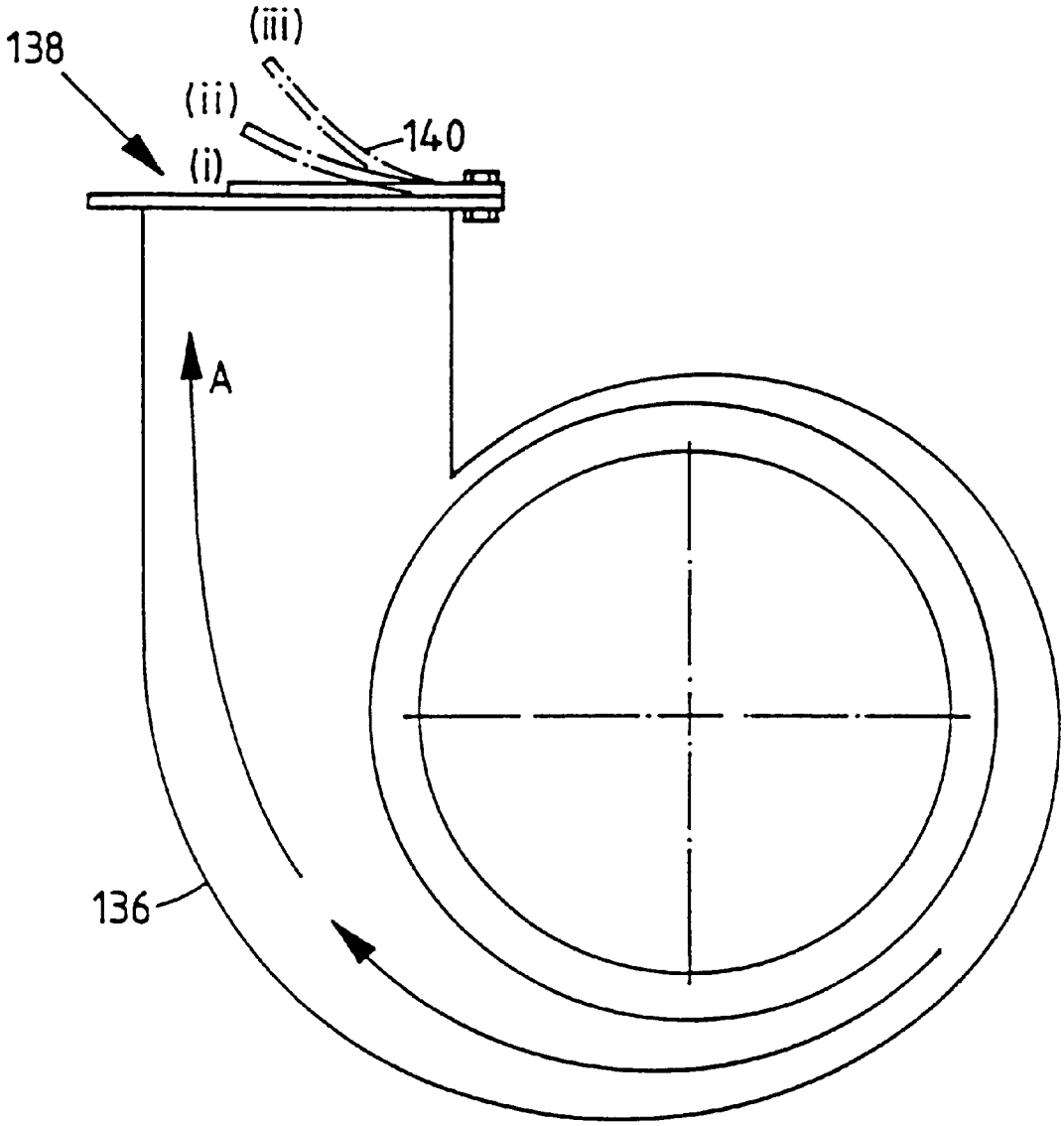
FIG. 13 is a diagrammatic illustration of the air vent of FIG. 12.

FIG. 13 shows the vent 136 of the suction fan 134. The vent 136 has an opening 138 which is partially covered by a bimetallic element 140. When air being expelled from the vent 136 through the opening 138 is cool, the bimetallic strip 140 is flat and is in position (i), almost completely covering the opening 138. Thus, the flow out of the vent 136 is restricted. As the temperature of gas flowing out of the opening 138 increases, the bimetallic element 140 bends away from the opening 138 through position (ii) and progressively into position (iii), thus reducing the restriction on flow and allowing more gas to pass.

It can be seen that in general, only part of the opening 138 is uncovered at any one time, but in the generally spiral outlet employed in this embodiment, this does not matter because escaping gas generally follows the route shown by arrow A. Thus, a greater proportion of escaping gas passes through the outer third of the outlet 138 and hence in its fully withdrawn position (iii) the bimetallic element 140 allows a sufficient volume of gas to pass.

The operation of the heater 110 of the present invention is generally as follows. The suction fan 134 draws air along the tube 112*b,* around the U-bend in the heater tube 112, and hence along the tube 112*a*. Thus, there is a negative pressure in the region of the burner 132. For this reason, air is drawn along the flow passage 114, being supplied to the passage via louvres 118. Since the louvres face the heater tube 112*b,* air will be drawn from the vicinity of that tube. Once the heater is running, air will remain in the elongate space surrounding the tube 112*b* through convection, and therefore can be expected to flow into the louvres 118 from along the entire length of the tube 112*b*.

Once it reaches the burner 132, air mixes with fuel and is ignited when it passes into inlet 130. Inlet 130 ensures that all flames pass into the inner liner 126, where they are fed with secondary air flowing from the space between the inner liner 126 and the burner tube 112*a* via perforations 128. Hence, inner liner 126 protects the burner tube 112*a* from the extreme temperature of the flames in the vicinity of the burner 132. However, since the temperature of the flame will decline along the length of the burner tube 112, the inner liner 126 is not required along the entire length and hence is shorter than the burner tube 112.

Inevitably, the tube 112*a* will be hotter than the tube 112*b,* and these two tubes will themselves have a graduated temperature therealong. However, the provision of the tubes in a U-formation means that, along the length of the heater, the average temperature of the two tubes remains substantially constant. Thus, the total radiative output of the heater is substantially constant along its length. In addition, the end of the tube 112*b* nearest the suction fan 134 will be at a such low temperature that its radiative efficiency will be very low compared to the equivalent portion of the burner tube 112*a*. However, this is not a problem in the present invention since the air around tube 112*b,* which would normally escape through convection without contributing to the radiative power of the heater, is instead drawn alongside tube 112*b,* through louvres 118, and used as pre-heated combustion air.

The heater 110 of the present invention is able to reach its operating temperature more quickly, due to the temperature-dependent restriction on the outlet 136, described above. Thus, when fully cold, the heater operates in a fuel-rich state in which there is little air (by volume) flowing along heater tubes 112. Thus, the working temperature is reached more swiftly. However, once that working temperature is reached, the flow restriction on the outlet 136 is substantially removed. This effect can be enhanced, if desired, by providing flow restrictions such as baffles within the tube 112*b*.

It will readily be apparent that numerous modifications and alterations may be made to the radiant heaters illustrated in the drawings and described above, without departing from the principles underlying the present invention, and all such modifications and alterations are intended to be embraced by this Application.

What is claimed is:

1. A radiant heater, comprising a radiative heating element, a housing, the underside of which is recessed to define a pair of channels arranged side by side and separated by a central barrier which tapers in a downward direction, the radiative heating element including a pair of radiant heater tubes each being disposed beneath the housing such that an upper half of said heater tubes is disposed wholly within the channel, and at least a portion of a lower half of said heater tubes protrudes downwardly from the channel, each said channel having a heat reflective surface for reflecting heat radiation from the radiant heater tube in a downwards direction, and wherein the housing includes means for enabling the attachment thereto of a reflective skirt for focusing the radiation emitted from the radiative heating element, wherein the housing is provided with a plurality of mounting brackets for attachment beneath the housing at spaced intervals thereon, the mounting brackets having first mounting means for supporting the tube beneath the housing, and second mounting means for the attachment thereto of the reflective skirt.

2. A radiant heater according to claim 1, wherein the radiant heater tube is heated by a gas burner or an electrically heated heating element.

3. A radiant heater according to claim 1, wherein the radiant heater tube comprises a burner communicating with one end of the tube, and extraction means communicating with the other end of the tube for extracting combustion gases from the tube.

4. A radiant heater according to claim 1, wherein the pair of radiant heater tubes constitute two limbs of a U-tube burner, the burner being arranged to communicate with one end of the U-tube, and the extraction means being arranged to communicate with the other end.

5. A radiant heater according to claim 1, wherein the radiant outputs of the radiant heater tubes are matched such that the radiant heater has a substantially uniform total radiant output along its length.

6. A radiant heater according to claim 1, wherein the central barrier extends downwardly such that a lower edge of said barrier is aligned with lower edges of the walls of the channels.

7. A radiant heater according to claim 1, wherein the central barrier has opposing walls which have an angle of inclination or a curvature which mirrors an angle of inclination or curvature of an opposing wall of the channel.

8. A radiant heater according to claim 1, wherein each said channel is adapted to function as a parabolic reflector.

9. A radiant heater according to claim 1, wherein each said channel has a generally planar upper surface, and generally planar side surfaces diverging downwardly from edges thereof.

10. A radiant heater according to claim 1, wherein the mounting brackets are attached to the housing by means providing a removable or fixed connection with the housing.

11. A radiant heater according to claim 1, wherein the housing is thermally insulated to limit heat loss through conduction and convection via upper and side surfaces of the housing.

12. A radiant heater according to claim 1, wherein the heat reflective surfaces are treated to reduce surface porosity and unevenness to improve reflectance.

13. A radiant heater according to claim 12, wherein the heat reflective surfaces are formed of an anodized aluminum.

14. A radiant heater according to claim 13, wherein the heat reflective surfaces are formed of a colored anodized aluminum.

15. A radiant heater according to claim 1, further comprising means for adjusting a height of one of the tubes within the housing.

16. A radiant heater according to claim 15, wherein the means for adjusting the height of the tube within the housing comprises one or more adjustable length cables extending between opposing mounting points on the mounting bracket, said cables and tubes being supported on said mounting bracket, the cables being adjustable such that shortening the length of the cable raised the height of the tube, lengthening the cable lowers the height of the tube.

17. A radiant heater according to claim 16, wherein the adjustable length cable comprises a flexible stainless steel cable having non-ferrous mountings and length adjusters on either end thereof.

18. A radiant heater as defined in claim 1, in combination with a reflective skirt for mounting on said mounting bracket.

19. A radiant heater according to claim 18, wherein the reflective skirt comprises one or more downwardly divergent walls, or generally parallel walls, or a combination thereof.

20. A radiant heater according to claim 19, wherein the reflective skirt comprises a reflective surface of the same composition as the reflective surface of the housing.

21. A radiant heater according to claim 19, wherein the reflective skirt comprises mounting points for securing said skirt directly to the housing.

22. A radiant heater according to claim 21, wherein the reflector skirt is adapted to be or riveted directly to the housing, and secured to the mounting brackets.

23. A process for fitting a heating system in a building, the heating system comprising overhead radiant heaters with skirt portions for directing the radiated heat towards a floor of the building, the process comprising the steps of measuring the building floor area A, determining the desired temperature rise $\Delta T$ above ambient, from A and $\Delta T$, determining the required floor radiant flux density Q, from Q and the performance of a heater, determining the number N of heaters, from A and N, determining a desired floor radiant flux pattern for an individual heater, from the floor radiant flux pattern, selecting a skirt having a configuration to achieve that pattern, attaching the selected skirt to a heater and installing the heater and skirt in the building.

* * * * *